United States Patent [19]

Kodera et al.

[11] Patent Number: 4,468,533

[45] Date of Patent: Aug. 28, 1984

[54] AIR CIRCUIT BREAKER

[75] Inventors: Toshihiko Kodera; Kiyoshi Eguchi; Takayoshi Ishikawa; Yasushi Genba; Shigemi Tamaru; Susumu Satou, all of Fukuyama, Japan

[73] Assignee: Mitsubishi Denki Kabushiki Kaisha, Tokyo, Japan

[21] Appl. No.: 460,794

[22] Filed: Jan. 25, 1983

[30] Foreign Application Priority Data

Jan. 29, 1982 [JP] Japan ..... 57/14490

[51] Int. Cl.[3] ..... H01H 3/46

[52] U.S. Cl. ..... 200/153 SC; 200/288; 200/327

[58] Field of Search ..... 200/153 SC, 153 G, 153 H, 200/288, 318, 321, 322, 323, 324, 325, 327

[56] References Cited

U.S. PATENT DOCUMENTS 3,652,815 3/1972 Davies ..... 200/153 SC
4,114,005 9/1978 Maier et al. ..... 200/153 G
4,144,427 3/1979 Grytcko et al. ..... 200/153 G
4,204,103 5/1980 Jährig et al. ..... 200/153 SC
4,324,963 4/1982 Maier et al. ..... 200/318

FOREIGN PATENT DOCUMENTS 2328971 1/1975 Fed. Rep. of Germany ..... 200/288
42-88614 10/1967 Japan .

*Primary Examiner*—Stephen Marcus
*Assistant Examiner*—Ernest G. Cusick
*Attorney, Agent, or Firm*—Oblon, Fisher, Spivak, McClelland & Maier

[57] ABSTRACT

The present invention describes an air circuit breaker having a bounce preventive device which is provided on the direction changing lever interposed between the link mechanism to drive the contact opening and closing mechanism for closure of the contact and the contact opening and closing mechanism, so as to prevent the bouncing phenomenon from occuring at the time of the OFF-operation, thereby making it possible to secure accurate circuit breaking action.

7 Claims, 13 Drawing Figures

(1). Further, as shown in FIG. 2, a handle returning spring (13) is extended between the base end part (11*b*) of the handle (11) and the side of the housing (1). A numeral (14) in FIG. 1 refers to a ratchet coaxially mounted on the abovementioned shaft (12), and numeral (15) refers to a movable pawl which is pivotally mounted on the base end part (11*b*) of the abovementioned handle (11) and is subjected to push-down force of a push-down spring (16) (see FIG. 2). The movable pawl is to intermittently drive the ratchet (14) counter-clockwise by the push-down operation of the handle (11). A reference numeral (17) designates a cam coaxially mounted on the shaft (12) and integrally coupled with the ratchet by means of a connecting pin (18). The cam (17) is so adapted that it can be driven even by an electric motor (not shown). A numeral (19) refers to a locking pawl which is pivotally mounted on a pivotal shaft 21 of a charge lever to be mentioned later to hinder the return rotation of the abovementioned ratchet (14).

A reference numeral (20) refers to the charge lever which extends upward from the back side of the cam (17), and is pivotally supported on a shaft (21) above the cam (17) in a rotatable manner. A roller (22) to be roll-contacted with the cam (17) at the time of the handle operation is mounted on a lower end part (20*a*) of the charge lever (20). Further, an obstructing piece (24) to be applied to a roller (23) of the cam (17) at the completion of the pressure accumulation is projectively provided in integration with the charge lever (20). A closed arm (26), an upper end part (26*a*) of which is pivotally supported on a shaft (25) in a rotatable manner, is disposed at the rear position of the lower end part (20*a*) of the charge lever (20). The closed arm (26) is connected with the lower end of the above-mentioned charge lever (20) through a link (27). Reference numerals (28), (29) designate connecting pins in the abovementioned link (27). A numeral (30) refers to an energy accumulating spring disposed at the lower end side of the rear part (right side in the drawing) of the housing (1), for which a compression coil spring is used. This spring (30) is mounted on an extendible spring holder (33), one end (33*a*) and the other end (33*b*) of which are pivotally and rotatably fitted on the lower end side (26*b*) of the closed arm (26) and the housing side (1), respectively through respective pins (31) and (32). The spring holder (33) is for effecting smooth compression deformation of the spring (30).

On the pivotal shaft (25) of the abovementioned closed arm (26), there is pivotally and rotatably supported a link (35) which is pushed up by a push-up piece (34) on the upper end side of the closed arm (26) at the time of de-energizing spring force from the abovementioned spring (30), and displaces in an arcuate manner. A reference numeral (36) designates a pin which is provided at the displaced end of the link (35) and pushed up by the push-up piece (34); a numeral (37) refers to an arcuate guide groove formed in the above-mentioned casing (2), into which the abovementioned pin (36) is fitted; and a numeral (38) denotes an obstructing pin preventing clockwise rotation of the closed arm (26). Numerals (39) and (40) refer to a pair of links which are disposed in the vertical direction on the upper end part (26*a*) of the closed arm (26), and connected to each other through a pin (41) in a bendable manner. The lower end part of the lower link (40) is connected with the abovementioned closed arm (26) by the pin (36). A numeral (42) refers to a pivotal shaft which is fixedly positioned above these links (39) and (40), i.e., in front of (left side in the drawing) the abovementioned casing (3) for the electric conduction section, and a numeral (43) denotes a direction changing lever which is pivotally and rotatably held on the shaft (42). To the lower end part (43*a*) of this lever (43), there is connected the upper end part of the upper link (39) of the abovementioned pair of links (39) and (40) through the connecting pin (44). The upper end part (43*b*) of the lever (43) has a pin (46), to which is connected one end of an insulating link (45) constituting a part of a contact opening and closing mechanism at the side of the electric conduction section, to be explained later. A link mechanism (47) for transmitting accumulated energy force is constructed with the abovementioned pair of links (39), (40), and associated forth. A reference numeral (48) designates a stopper to hinder passage of the direction changing lever (43) through its original (or initial) position and its further counter-clockwise rotation beyound the original position. A reference numeral (49) denotes a movable piece pivotally mounted on a pin (44) at the lower end of the direction changing lever (43). Between this movable piece (49) and the direction changing lever (43), there is extended a return spring (50) for the movable piece (49). This movable piece (49) is so set that, when the direction changing lever (43) is displaced for its return motion under force of a contact-pressing spring (62) at the time of OFF-operation to be mentioned later, it may be applied to the stopper (48). On an end face (49*a*) of this movable piece (49) facing the abovementioned stopper (48), there is formed an engaging and stopping part (49*c*) in the shape similar to a notch so as to be engaged with and stopped by the stopper (48) in an engageable and disengageable manner, when the abovementioned direction changing lever (43) collides with the stopper (48) and tends to be bounced back.

Numerals (51) and (52) in FIG. 1 refer to a pair of conductors constituting a part of the electric conduction section; a reference numeral (53) designates a current transformer provided in one of the conductors (51); and a numeral (54) denotes a main fixed contact point secured at the tip end of this conductor (51). A reference numeral (56) represents a movable piece, on which the movable contact (55) is fixedly secured. The base end part of this movable piece (56) and the other conductor (52) are connected with a flexible conductor (57). A numeral (58) denotes a movable piece holder to hold the movable piece (56) through a pivot pin (59). The lower end part of this holder (58) is pivotally and rotatably supported on the casing (3) through a pivotal shaft (60), while the upper end part thereof is connected to other end of the abovementioned insulating link (45) through a pin (61). A numeral (62) refers to a contact-pressing spring which extends between the abovementioned movable piece (56) and the casing side (3) to impart to this movable piece (56) a spring force in the direction of the contact closure; numerals (63) and (64) respectively refer to a movable arc contact and a fixed arc contact; numerals (65) and (66) denote respectively holding members for the arc contacts (63) and (64); and a numeral (67) refers to a stopper for restricting rotation of the movable piece holder (58). A contact opening and closing mechanism (69) is constructed with the above-mentioned movable piece (56), movable piece holder (58), insulating link (45), and associated elements (see FIGS. 6 and 7). Reference numerals (70) and (71) designate partition walls.

AIR CIRCUIT BREAKER

BACKGROUND OF THE INVENTION

This invention relates to an air circuit breaker and more particularly, a rebound prevention device to effect a controlled opening during OFF-operation of the air circuit breaker.

This type of circuit breaker uses a link mechanism and a trip mechanism for opening and closing both fixed and movable contact pieces. The operation of the link mechanism is done by utilizing resilient force of a spring to be actuated by operation of the trip mechanism. Since the opening and separating action of the contact pieces need to be done instantaneously, a spring having a strong resilient force is usually employed. With such spring of a strong resilient force, however, there takes place a bouncing or spring-back phenomenon, and, in an extreme case, re-ignition occurs inevitably. In order, therefore, to prevent this bouncing phenomenon from taking place in the contact opening and closing mechanism, there have so far been proposed various expedients with no fruitful result of any bounce preventive mechanism, which is most reliable in its operation, having been realized.

SUMMARY OF THE INVENTION

In view of the abovementioned circumstances, the present invention sets its object in providing an air circuit breaker which, by providing an improved bounce preventive means on a direction changing lever interposed between the link mechanism which drives the contact opening and closing mechanism at the time of ON-operation and the contact opening and closing mechanism, inhibits the direction changing lever from colliding with, and springing back from, a stopper at the time of OFF-operation, thereby securing accurate opening and closing operation of the contact points.

According to the present invention, in general aspect thereof, there is provided an air circuit breaker which comprises, in combination: a handle rotatably pivoted in a housing of the circuit breaker; an energy accumulating spring to accumulate pressure therein by operation of said handle; a link mechanism to transmit pressure force of said energy accumulating spring to the side of a contact opening and closing mechanism in said housing; a direction changing lever interposed between said link mechanism and said contact opening and closing mechanism; and a stopper which is provided to the side of said housing to hinder the rotational displacement in the returning direction of said direction changing lever, at its original position, which has been subjected to a stretching force of a contact-pressing spring in said contact opening and closing mechanism at the time of OFF-operation, a movable piece being pivotally supported on said direction changing lever so as to be in contact with said stopper against force of a return spring extending between said direction changing lever and said movable piece, when said direction changing lever is hindered in rotation by said stopper, and said movable piece having formed therein an engaging part which inhibits bouncing of said direction changing lever by engaging and stopping the same with and at said stopper due to inertia of its own, when said direction changing lever collides with said stopper and tends to bounce or spring back therefrom.

BRIEF DESCRIPTION OF THE DRAWINGS

The foregoing object, other objects as well as specific construction and operations of the air circuit breaker according to the present invention will become more apparent and understandable from the following detailed description thereof when read in conjunction with the accompanying drawing.

In the drawing.

In the following, the present invention will be explained in specific details with reference to a preferred embodiment of the air circuit breaker according to the present invention as shown in the accompanying drawing.

Figure 1:
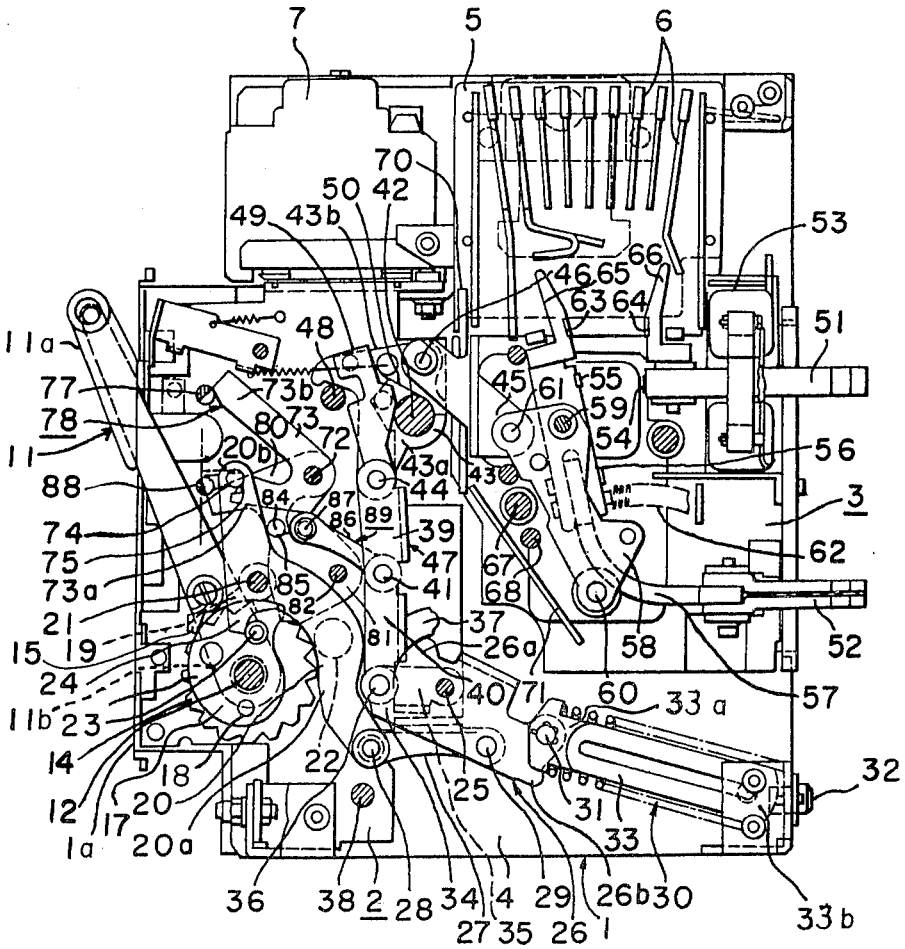
FIG. 1 is a side elevational view showing one embodiment of the air circuit breaker according to the present invention.
Figure 2:
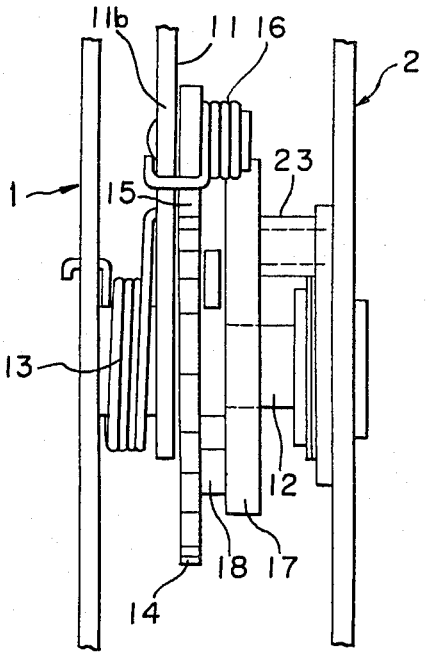
FIG. 2 is an explanatory diagram of a shaft part of a handle.

Referring first to FIG. 1 showing a cross-sectional side elevational view of one embodiment of the air circuit breaker according to the present invention, a reference numeral (1) designates a housing, a numeral (2) refers to a unit casing for an energy accumulating section, and a numeral (3) denotes a unit casing for an electric conduction section. The unit casing (2) for the energy accumulating section is positioned at the front side (left side as viewed from the top surface of the drawing sheet) of the casing, while the unit casing (3) for the electric conduction section is positioned at the rear side thereof (right side as viewed from the top surface of the drawing sheet). Both unit casings 2, 3 are fixedly secured to a side plate (4) constituting a part of the housing (1). A reference numeral (5) designates an arc extinguishing chamber having a plurality of arc extinguishing plates (6) and being engaged with the abovementioned unit casing (3) for the electric conduction section, and a numeral (7) refers to a casing for an electric control section such as a trip relay, and others.

In the following, the constructions of the abovementioned energy accumulating section and electric conduction section will be explained in details.

A reference numeral (11) designates an operating handle disposed in the housing in a posture of a frontward inclination. An operating end part (11*a*) of this handle (11) projects outward from the upper portion of a front wall (1*a*) of the abovementioned unit casing (2) for the energy accumulating section, while a base end part (11*b*) thereof is rotatably pivoted on the abovementioned unit casing (2) for the energy accumulating section by means of a shaft (12) provided at a position close to the lower part of the front face (1*a*) of the housing At a position above the charge lever (20), there is disposed a closing latch (73) in the form of a letter "J" or a fish-hook, which is pivotally supported on a pivotal shaft (72) in a rotatable manner. At the distal end of the lower end part (73*a*) of this latch (73), there is formed a notched portion (75) to receive therein urging force in the clockwise direction of an engaging and stopping roll (74) fixed at the upper end part (20*b*) of the charge lever (20). The notched portion is so set that, at the completion of the pressure accumulation, the abovementioned urging force may be against the clockwise spring force of the return spring (76) (see FIG. 4). A reference numeral (77) designates a latch having a D-shaped cross-section which engages and stops the upper end (73*b*) of the abovementioned closing latch (73) in an engageable and disengageable manner to hinder the counter-clockwise rotation thereof. The latch (77) is rotatably mounted on the casing (2), and constructs a stand-by maintaining mechanism (78) for the contact closure together with the abovementioned closing latch (73), and associated elements. The D-shaped latch (77) is so adapted that it may rotate counter-clockwise by an ON-operating member (79) (FIG. 3) which releases the abovementioned closure stand-by state.

Figure 5:
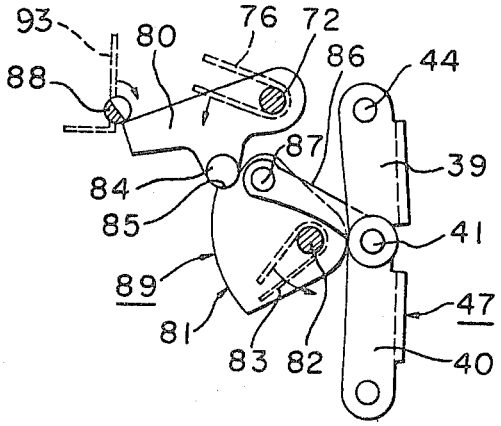
FIG. 5 is an explanatory diagram of a stand-by mechanism for opening of contacts.

A numeral (80) refers to a trip latch which is rotatably pivoted on the pivotal shaft (72) of the closing latch (73) and is subjected to a counter-clockwise spring force of the abovementioned return spring (76) (see FIG. 5). A space numeral (81) refers to a cam plate which is rotatably pivoted on a shaft (82) below the trip latch (80), and to which counter-clockwise spring force of the return spring (83) shown in FIG. (5) is imparted. The cam plate (81) is so constructed that it has a recessed portion (85) adapted to be engaged with an engaging and stopping roll (84) at the projected lower end part of the trip latch (80) in an engageable and disengageable manner, and imparts to the trip latch (80) clockwise urging force against force of the return spring 76. A reference numeral (86) in FIG. 1 designates a cross-bridging link connected between a pin (87) of the cam plate (81) and the connecting pin (41) in the abovementioned pair of links (39) and (40). A numeral (88) refers to a latch having a D-shaped cross-section to inhibit the clockwise rotation of the abovementioned trip latch (80). The latch (88) is rotatably mounted on the casing (2), and constructs a stand-by maintaining mechanism (89) for the contact opening, which causes the abovementioned link mechanism (47) to stretch against the spring force of the abovementioned contact-pressing spring (62). The D-shaped latch (88) is so formed that it may be rotated in the clockwise direction by the OFF-operating member (90) shown in FIG. 3. Incidentally, in FIG. 3, a reference numeral (91) designates an automatic return spring for the D-shaped latches (77) and (88); numerals (92) and (93) respectively refer to members provided on the D-shaped latches (77) and (88) to be subjected to operation; (94) and (95) denote stoppers; (96) and (97) represent push-in rods; and (98) and (99) denote stopper arms operatively associated with stoppers (94), (95) and latches (77), (88), respectively.

In the following, actual operations of the abovementioned construction will be explained.

Figure 8:
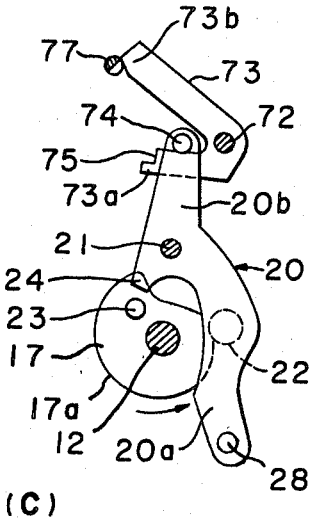
FIGS. 8(A), 8(B) and 8(C) are respectively explanatory diagrams for the operation of the charge lever.
Figure 8:
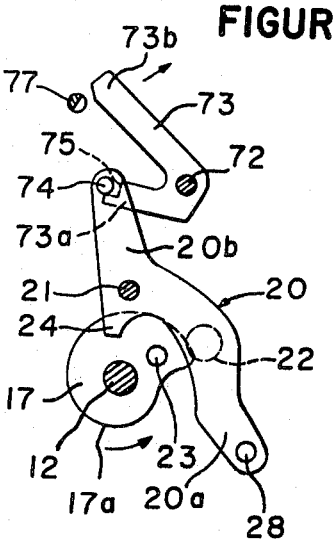
Figure 8:
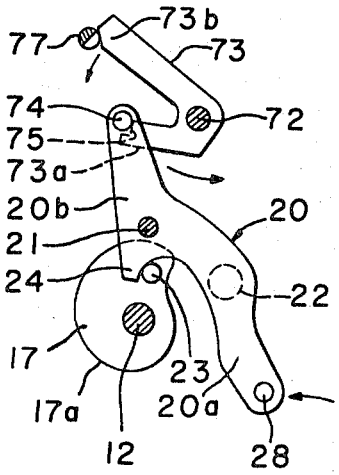

(I) At the time of energy accumulation in the energy accumulating spring:

First of all, when the handle (11) in FIG. 1 is subjected to push-down operation against force of the return spring (13), the movable pawl (15) rotates the ratchet (14) in the counter-clockwise direction, and the cam (17) is thereby rotated in the same direction; accordingly, the charge lever (20) is rotated counter-clockwise with its shaft (21) as the center of rotation through the roller (22) which is roll-contacted to the cam surface (17*a*) (see FIG. 8(A)). By this rotational displacement of the charge lever (20) in the counter-clockwise direction, the closed arm (26) rotationally displaces in the counter-clockwise direction around the shaft (25) through the link (27), whereby compression of the energy accumulating spring (30) starts. The compressive deformation of the energy accumulating spring (30) further proceeds by repetition of the abovementioned handle operations.

By carrying out the push-down operation of the abovementioned handle (11) for a predetermined number of times, e.g., several times, the cam (17) is slightly rotated in the counter-clockwise direction from a position where the charge lever (20) is displaced in its maximum amount (see FIG. 8(B)), while, at the same time, the roller (23) collides with the obstructing member (24) on the charge lever (20) (see FIG. 8(C)), whereby rotation of the cam (17) is hindered and the pressure accumulating operation of the energy accumulating spring (30) is completed (see FIG. 1).

At the completion of the abovementioned pressure accumulating operation, stretched spring force of the energy accumulating spring (30) tends to rotate the abovementioned charge lever (20) about its shaft (21) in the clockwise direction through the closed arm (26) and the link (27). On account of this, the engaging and stopping roll 74 at the upper end of the charge lever (20) urges the notched part (75) at the lower end of the closing latch (73) to cause the latch to rotate counter-clockwise against force of the return spring (76). However, on account of the abovementioned counter-clockwise rotation of the closing latch (73), the upper end (73*b*) of the closing latch (73) is engaged with, and stopped at, the D-shaped latch (77), and the counter-clockwise rotation of the closing latch (73), in other words, the clockwise rotation of the charge lever (20), is hindered (see FIGS. 4 and 8(C)). Accordingly, the push-up force of the closed arm (26) transmitted to the pin (36) in the link mechanism (47) is also hindered, and the closure of the contacts (54), (55) is set in a stand-by state through the abovementioned link mechanism (47).

Figure 3:
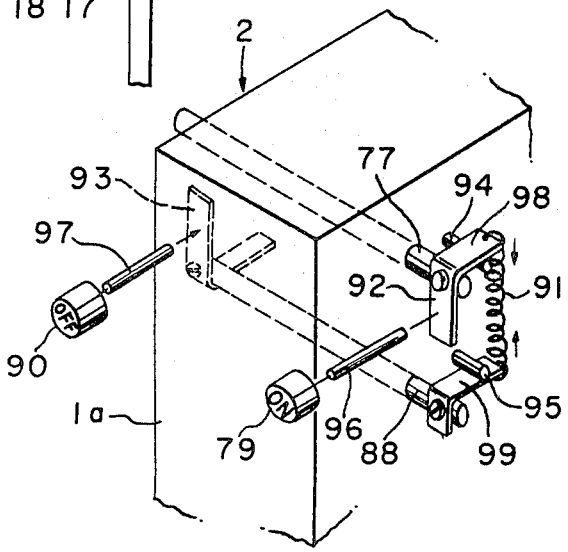
FIG. 3 is a schematic structural diagram of an ON-OFF operating section in the air circuit breaker according to the present invention.
Figure 4:
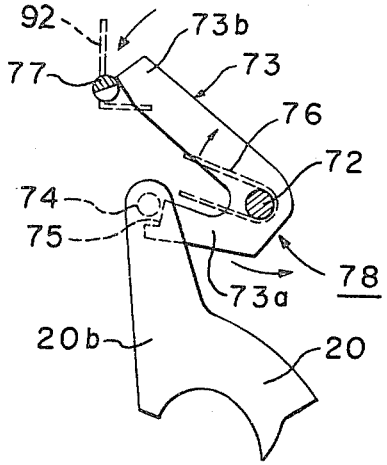
FIG. 4 is an explanatory diagram of a stand-by maintaining mechanism for closure of contacts.
Figure 6:
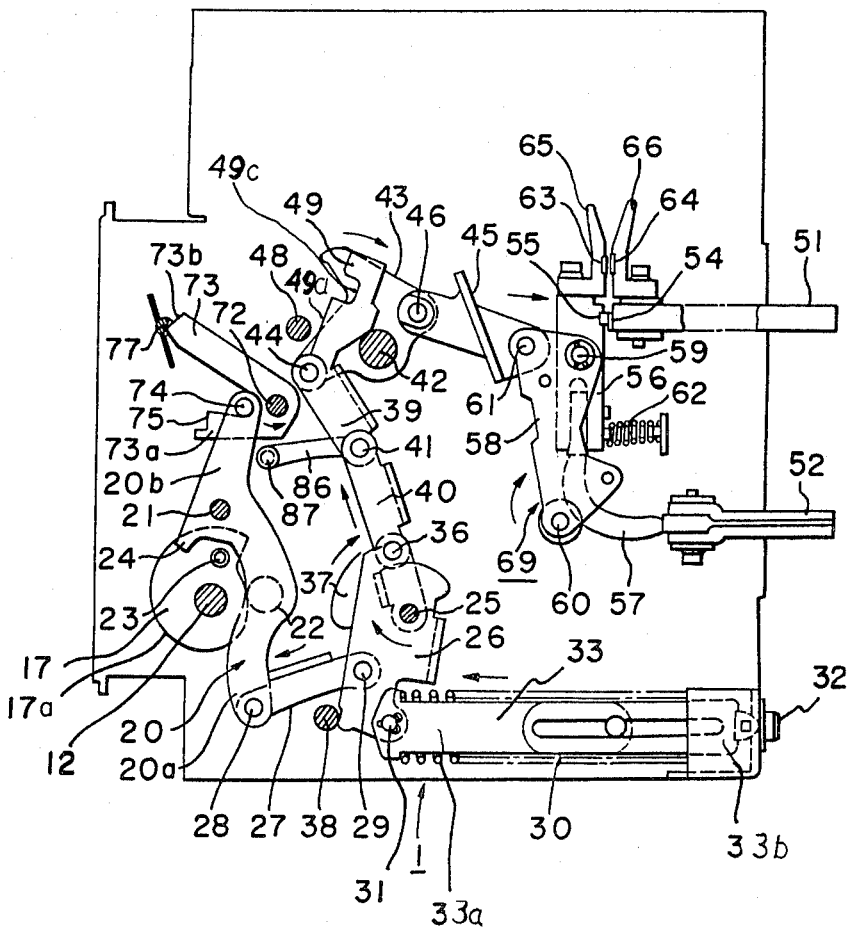
FIG. 6 is a diagram showing an operational state of the breaker at the time of the ON-operation.

(II) At the time of ON-operation:

At first, when the ON-operating member (79) shown in FIG. 3 is operated against force of the automatic return spring to rotate the D-shaped latch (77) in the counter-clockwise direction, the closing latch (73) rotates counter-clockwise from its state as shown in FIG. 8(C). On account of this, the engaging and stopping roll (74) at the upper end part (20*b*) of the charge lever (20) is released from the notched part (75) of the closing latch (73), and the charge lever (20) is subjected to the force of the energy accumulating spring to be rotated in the clockwise direction, as shown in FIG. 6. In consequence of this, the closed arm (26) is also rotated about the shaft (25) in the clockwise direction through the link (27). By the rotation of the abovementioned closed arm (26) under force of the energy accumulating spring, the push-up piece (34) of this closed arm (26) pushes the pin (36) upward and moves the same along the guide slot (37), hence the pair of links (39) and (40) are also displaced upward and driven in their stretched state.

By the upward displacement of the links (39) and (40), the direction changing lever (43) rotates clockwise. The rotational force of this lever (43) is transmitted to the contact point opening and closing mechanism (69) through the insulated link (45). In more detail, since the holder (58) of the movable piece (56) is rotated clockwise with its shaft (60) as the center of rotation, the movable contact (55) comes into contact with the fixed contact point (54) against force of the contact-pressing spring (62) to bring about the contact point closure state. In this state, the energy accumulating spring (30) is de-energized, while the contact-pressing spring (62) is compressed for energy accumulation.

In the state as mentioned above where the energy accumulating spring (30) is de-energized and the contact points (54) and (55) are closed, the spring force of the contact-pressing spring (62) tending to stretch is apt to rotate the direction changing lever (43) about the shaft (42) in the counter-clockwise direction through the movable piece (56), holder (58), and insulated link (45).

Incidentally, since the abovementioned direction changing lever (43) is subjected to the rotational force in the counter-clockwise direction, the pair of links (39) and (40) connected to this lever (43) are subjected to the rightward urging force, by which urging force the cam plate (81) is subjected to the clockwise rotational force about the shaft (82) through the link (86) as shown in FIG. 5. On account of this, the cam plate (81) pushes the trip latch (80) against force of the return spring (83) to impart clockwise rotational force to this trip latch (80), although this rotational force is hindered by the D-shaped latch (88). On account of this, the engaged state between the abovementioned recessed part (85) and the engaging and stopping roll (84) remains in their engaged state, whereby the cross-bridging force due to the latch (80) acts on the abovementioned links (39) and (40). Accordingly, the pair of links (39) and (40) are maintained in their stretched condition against the stretching force of the contact-pressing spring (62). This, in other words, sets the stand-by maintaining mechanism for opening the contact point to be in its on-state.

Figure 7:
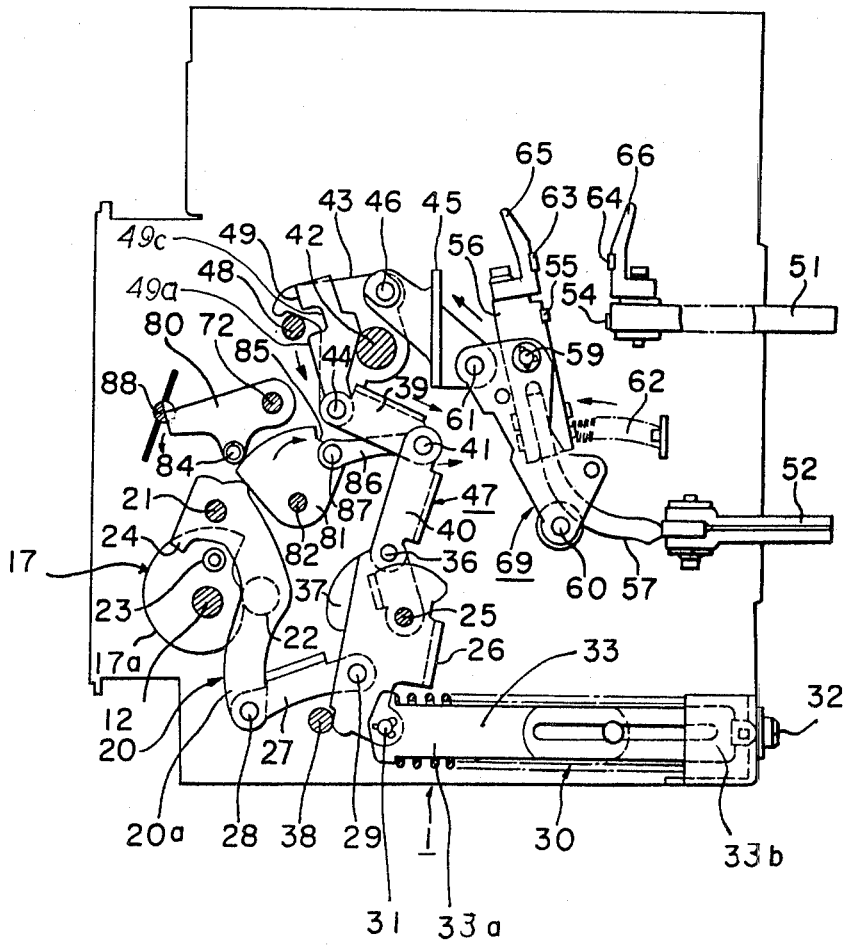
FIG. 7 is a diagram showing an operational state of the breaker at the time of the OFF-operation.

(III) At the time of OFF-operation:

At first, when the OFF-operating member (90) shown in FIG. 3 is operated against force of the automated return spring to rotate the D-shaped latch (88) in the clockwise direction, the trip latch (80) slightly displaces rotationally in the clockwise direction against force of the return spring (76) from its state as shown in FIG. 5, whereby the engaging and stopping roll (84) of this latch (80) and the recessed part (85) of the cam plate (81) are released from their engagement. On account of this, the abovementioned cam plate (81) is rotated clockwise as shown in FIG. 7 against force of the return spring (83). As the consequence of this, the cross-bridging action of the link (86) is reduced, and the pair of links (39) and (40) are bent down in a collapsed fashion due to stretching force of the abovementioned contact-pressing spring (62), whereby the abovementioned contacts (54) and (55) are opened.

In the open state of the contact points (54) and (55), i.e., in the state as shown in FIG. 7, when the abovementioned handle operation is resumed for the pressure accumulation in the energy accumulating spring (30), the links (39) and (40) are stretched accordingly, while displacing downwardly, and the cam plate (81) is rotationally displaced counter-clockwise by the force of the return spring (83), hence the recessed part (85) of the cam plate (81) becomes engaged with the engaging and stopping roll (84) of the trip latch (80) to thereby assume the state as shown in FIG. 1.

Incidentally, at the time of the abovementioned OFF-operation, the direction changing lever (43) which displaces for its return motion under force of the contact-pressing spring (62) tends to violently collide with the stopper (48) fixedly provided in the unit casing (2) for the energy accumulating section and to bounce back. If this bouncing motion is too strong, the movable contact (55) which has once been opened is again approaching its closure direction, thereby deteriorating the circuit breaking performance.

Figure 9:
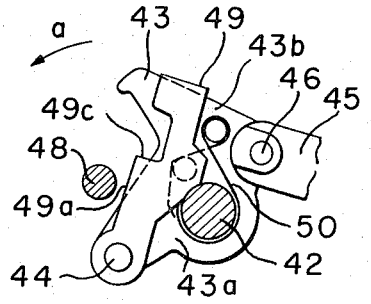
FIG. 9(A), 9(B) and 9(C) are respectively explanatory diagrams for operations of the main part of the present invention.
Figure 9:
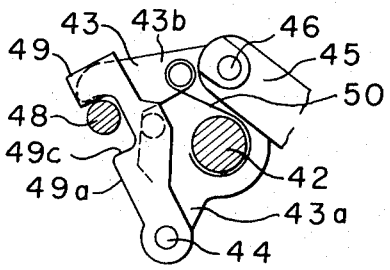
Figure 9:
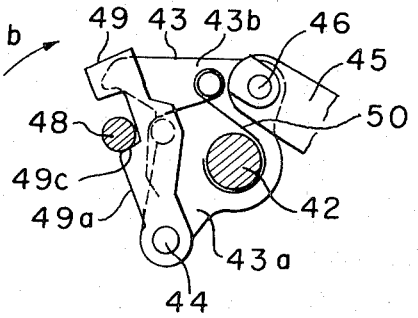

According to the above-described construction of the air circuit breaker of the present invention, however, the direction changing lever (43) displaces to its returning direction (a direction shown by an arrow a in FIG. 9(A)) and comes into contact with the stopper (48), and, at the same time, the movable piece (49) comes into contact with the stopper (48) on its own inertia against force of the return spring (50), as shown in FIG. 9(B). At this instant, the direction changing lever (43) also comes into contact with the stopper (48). If the reaction force is great, the direction changing lever (43) rotationally displaces in the clockwise direction with the shaft (42) as the center of oscillation, tending to bounce back in the arrow direction b in FIG. 9(C). By the rotational displacement of this direction changing lever (43), the movable piece (49) as a whole also displaces clockwise about the shaft (42). On account of this, the engaging and stopping part (49*c*) formed in the movable piece (49) is engaged with, and stopped by, the stopper (48) as shown in FIG. 9(C), whereby the direction changing lever (43) does not rotate clockwise any farther; in other words, excessive bouncing of the lever (43) is inhibited, and the opening operation of the contacts (54) and (55) can be secured. Needless to say, the abovementioned engaging and stopping part (49*c*) is not limited to the notch, but it can be constructed with a projected piece, etc.

As described in the foregoing, the air circuit breaker according to the present invention provides a bounce preventive device on the direction changing lever interposed between the link mechanism to drive the contact opening and closing mechanism for closure of the contact and this contact opening and closing mechanism, so as to prevent the bouncing phenomenon to occur at the time of the OFF-operation, thereby making it possible to secure accurate circuit breaking action.

In the foregoing, the present invention has been described with reference to a preferred embodiment as illustrated in the drawing. It should, however, be noted that the embodiment is merely illustrative and not restrictive, and that any changes and modifications may be by those persons skilled in the art within the spirit and scope of the present invention as recited in the appended claims.

What is claimed as new and desired to be secured by Letters Patent of the United States is:

1. In an air circuit breaker including a handle operatively associated with said air circuit breaker for generating a compression force, an energy accumulating spring for effecting closing of electrical contacts in said air circuit breaker, force transmitting means operatively associated with said handle and said energy accumulating spring for transmitting said compression force generated by said handle to said energy accumulating spring for compression thereof, a contact opening and closing mechanism for opening and closing said electrical contacts of said air circuit breaker, a direction changing lever operatively associated with said contact opening and closing mechanism and a link mechanism operatively associated with said direction changing lever and said force transmitting means to transmit said compression force accumulated in said energy accumulating spring to said contact opening and closing mechanism to close said electrical contacts, a rebound prevention device, comprising:

a stopper adapted to cooperate with said direction changing lever such that when said direction changing lever is rotated to an original position by a contact mechanism spring force during an OFF-operation of said air circuit breaker said direction changing lever collidingly contacts said stopper at said original position and is prevented from rotation therepast;

a movable piece pivotally supported on said direction changing lever and contacting said stopper when said direction changing lever collidingly contacts said stopper, said movable piece including an engaging part which stoppingly engages said stopper when inertia of said movable piece pivotally rotates said movable piece into contact with said stopper during said OFF-operation, and wherein said movable piece is adapted to cooperate with said direction changing lever to prevent a rebounding movement of said direction changing lever from said stopper; and a return spring operatively associated with said movable piece and said direction changing lever and adapted to cooperate with said movable piece such that said movable piece contacts said stopper against a force of said spring.

2. The air circuit breaker as claimed in claim 1 further comprising a ratchet and a cam mechanism operatively associated with said handle for generating said compression force and wherein said force transmitting means further comprises a charge lever and a closed arm operatively associated with said cam mechanism.

3. The air circuit breaker as claimed in claim 2 wherein said compression force of said energy accumulating spring is transmitted through said closed arm to move said link mechanism to a longitudinally extended position and further wherein said compression force is transmitted from said link mechanism to said direction changing lever and thence to said contact opening and closing mechanism.

4. The air circuit breaker as claimed in claim 2 wherein said charge lever includes an upper end engaged with first standby maintaining mechanism for closing said electrical contacts.

5. The air circuit breaker as claimed in claim 2 further comprising a link pivotally supported in said link mechanism and engaged with a second standby maintaining mechansim for opening said electrical contacts.

6. The air circuit breaker as claimed in claim 1 wherein said contact opening and closing mechanism further comprises a contact-pressing spring operatively associated with said direction changing lever and biasing said direction changing lever in a counterclockwise direction so as to collidingly contact said stopper when said electrical contacts are opened.

7. The air circuit breaker as claimed in claim 1 wherein said movable piece is pivotally supported on said direction changing lever in a rotatable manner and biased in a clockwise direction by said return spring.

* * * * *